US006192929B1

(12) United States Patent
Matsumoto

(10) Patent No.: US 6,192,929 B1
(45) Date of Patent: Feb. 27, 2001

(54) HYDRAULIC CONTROLLER

(75) Inventor: Satoshi Matsumoto, Kanagawa (JP)

(73) Assignee: Toshiba Machine Co., Ltd., Tokyo (JP)

( * ) Notice: Subject to any disclaimer, the term of this patent is extended or adjusted under 35 U.S.C. 154(b) by 0 days.

(21) Appl. No.: 09/299,641

(22) Filed: Apr. 27, 1999

(30) Foreign Application Priority Data

Apr. 28, 1998 (JP) ..... 10-119745

(51) Int. Cl.[7] ..... F15B 13/08

(52) U.S. Cl. ..... 137/596.13; 60/460; 91/420; 91/446; 91/518; 137/596.1

(58) Field of Search ..... 60/460; 91/420, 91/446, 518; 137/596.1, 596.13

(56) References Cited

U.S. PATENT DOCUMENTS 4,020,867 * 5/1977 Sumiyoshi ..... 91/420 X

* cited by examiner

*Primary Examiner*—Gerald A. Michalsky

(74) *Attorney, Agent, or Firm*—McGinn & Gibb, PLLC

(57) ABSTRACT

The present invention provides a hydraulic controller comprising: a plurality of switching spools; a plurality of cylinder ports of a switching valve; a compressed oil passage common to the switching valves having an intermediate chambers, at least a check valve in correspondence with at least a part of said switching spools, and said check valve being positioned between said intermediate chambers and said cylinder ports, so that said switching spools being positioned in a neutral position to close said passage and also being movable to adjust opening degree of said passage, wherein auxiliary ports are provided between the cylinder ports and a tank line; flow rate adjusters are also provided between the auxiliary ports and the tank line for adjusting an opening degree of the passage; pressure detectors are provided in the switching valves for detecting pressures of oils in the intermediate chambers; a maximum pressure selector operatively linked to said pressure detectors for selecting a maximum pressure from the detected pressures by the pressure detectors; whereby the pressures of said intermediate chambers are applied to the flow rate adjusters in an opening direction, while the selected maximum pressure selected by said maximum pressure selector is applied to the flow rate adjusters in a closing direction.

10 Claims, 4 Drawing Sheets

HYDRAULIC CONTROLLER

BACKGROUND OF THE INVENTION

This invention relates to a hydraulic controller in hydraulic valves used in construction equipments, and more particularly to a hydraulic controller with low pressure loss, superior responsibility, high stability, and in complex-operability.

The hydraulic control valve as shown in FIG. 4 has been known as hydraulic controllers.

Thus hydraulic control valve as illustrated in FIG. 4 has the following elements. A switching spool 12 is accommodated in a valve body 10. A compressed oil is supplied from a supplying passage 14 of a hydraulic pump to a cylinder port 16*a* or 16*b*. In connection with a relative movement of the switching spool 12 to the valve body 10, a passage from the supplying passage 14 to an oil chamber 18 is opened, whereby, the compressed oil having entered into the oil chamber 18, is reached to an oil chamber 20, so that when the switching spool 12 is in a neutral position, a plunger 24 is moved upwardly, which blocks passages 22, 22 extending between the oil chamber 20 and a cylinder port 16*a* or 16*b* positioned in downstream side of the oil chamber 20, before the pressured oil enters into the passages, 22, 22 and then into the cylinder port 16*a* or 16*b*.

In a back chamber 25 of the plunger 24, when the compressed oil applying onto plunger 24 is passed from the oil chamber 20 to the passage 22, almost constant pressure drop appears such as to allow the plunger 24 to act as a pressure compensation means as well as the plunger 24 to exhibit a certain operation. For these purposes, a spring 26 is provided to apply its elastic force to the plunger 24, whereby the oil chamber 20 is shut from the passage 22. If, however, this spring 26 is not provided, the plunger 24 has no stable balanced position, thereby making it difficult to stabilize the pressure compensation function.

The back chamber 25 of the plunger 24 is connected to the outside through a communication passage 28 which may optionally be further connected to the tank circuit 29 trough the throttle.

For the well-known hydraulic control valves, other than the above, in order to supply the compressed oil from the supplying passage of the hydraulic pump, a movable member is provided as a pressure compensation valve on the passage of the compressed oil, and further in order to cause a constant pressure reduction in the upstream and downstream sides of the movable member, the spring force is designed to work on the movable member in such a way to close the passage to the cylinder port from the supplying passage.

However, there had remained various problems with the conventional hydraulic control valves, which should have to be solved.

In the prior art mentioned above, the pressure compensation valves are provided between the supplying passage and the cylinder port, and the pressure compensation valves are free from a compressed fluid action applied with the spring force such as to close the supplying passage to the a cylinder port from the hydraulic pump. Therefore, in order to operate the switching spool for causing the compressed oil to be flowed into the cylinder port, it is necessary that the pressure compensation valve is kept open against the spring force. In order to provide the function as the pressure compensation valve, it is also necessary that the spring force is not so faint, whereby the pressure loss corresponding the spring force is caused, making it difficult save energy.

Furthermore, in the hydraulic control valve as shown in FIG. 4, the back chamber of the plunger is connected to the tank circuit through the throttle. When the switching spool is in a non-operating state, the hydraulic control valve is kept closing the passage to the cylinder port from the supplying passage of the hydraulic pump. If the hydraulic control valve is used in a cold district, then the hydraulic oil has an extremely high viscosity. For this reason, if the high viscosity hydraulic oil is used for quick start, then the hydraulic oil in the valve chamber of the hydraulic control valve is exhausted to the outside through the throttle.

This exhaust takes some time during which the plunger remains in position, whereby the movement of the plunger as the pressure compensation valve for opening the upstream and downstream passages is likely to be delayed in response.

In this case, this response may be improved by widening the opening degree of the throttle. In order to but in order to keep the pressure compensation valve in good performance, it is however necessary to increase the quantity of the discharged oil from the throttle. This may raise another problem in difficulty to save energy for the whole system.

Furthermore, in concurrent operations of two spools, all of the pressure compensation valves must be equilibrated individually in the respective neutral positions between the closed and opened positions. Accordingly, these values tend to be influenced mutually, and thus it is required to consider the safety enough well.

In the prior art, a flow rate regulating device is connected between a switching valve and a cylinder port, that is, an actuator is connected to a hydraulic control device.

In this case, by limit the supply of the oil from a hydraulic pump to an actuator, namely by the flow rate control is made by the meter-in control. When the hydraulic control unit is used in the construction equipment, the following problem is raised. Though the load reduced with empty weight should be under the meter-out control, the degree of opening on the side of the meter-in control is limited as described above, whereby a cavitation is formed due; to insufficient supply of the compressed oil to the actuator, thereby making difficult a smooth operation of the load.

Upon repeated earnest studies and investigations the inventor could confirm the following facts.

SUMMARY OF THE INVENTION

An object of the present invention to provide a novel hydraulic controller with a reduced pressure loss and good responsibility and stability as well as good operability of operating plural switching spools.

The present invention provides a hydraulic controller comprising: a plurality of switching spools; a plurality of cylinder ports of a switching valve; a compressed oil passage common to, the switching valves having an intermediate chambers, at least a check valve in correspondence with at least a part of said switching spools, and said check valve being positioned between said intermediate chambers and said cylinder ports, so that said switching spools being positioned in a neutral position to close said passage and also being movable to adjust opening degree of said passage, wherein auxiliary ports are provided between the cylinder ports and a tank line; flow rate adjusters are also provided between the auxiliary ports and the tank line for adjusting an opening degree of the passage; pressure detectors are provided in the switching valves for detecting pressures of oils in the intermediate chambers; a maximum pressure selector operatively linked to said pressure detectors for selecting a maximum pressure from the detected pressures by the pressure detectors; whereby the pressures of said intermediate chambers are applied to the flow rate adjusters in an opening direction, whilst the selected maximum pressure selected by said maximum pressure selector is applied to the flow rate adjusters in a closing direction.

BRIEF DESCRIPTION OF THE DRAWINGS

Preferred embodiments according to the present invention will be described in detail with reference to the accompanying drawings.

DISCLOSURE OF THE INVENTION

Figure 1:
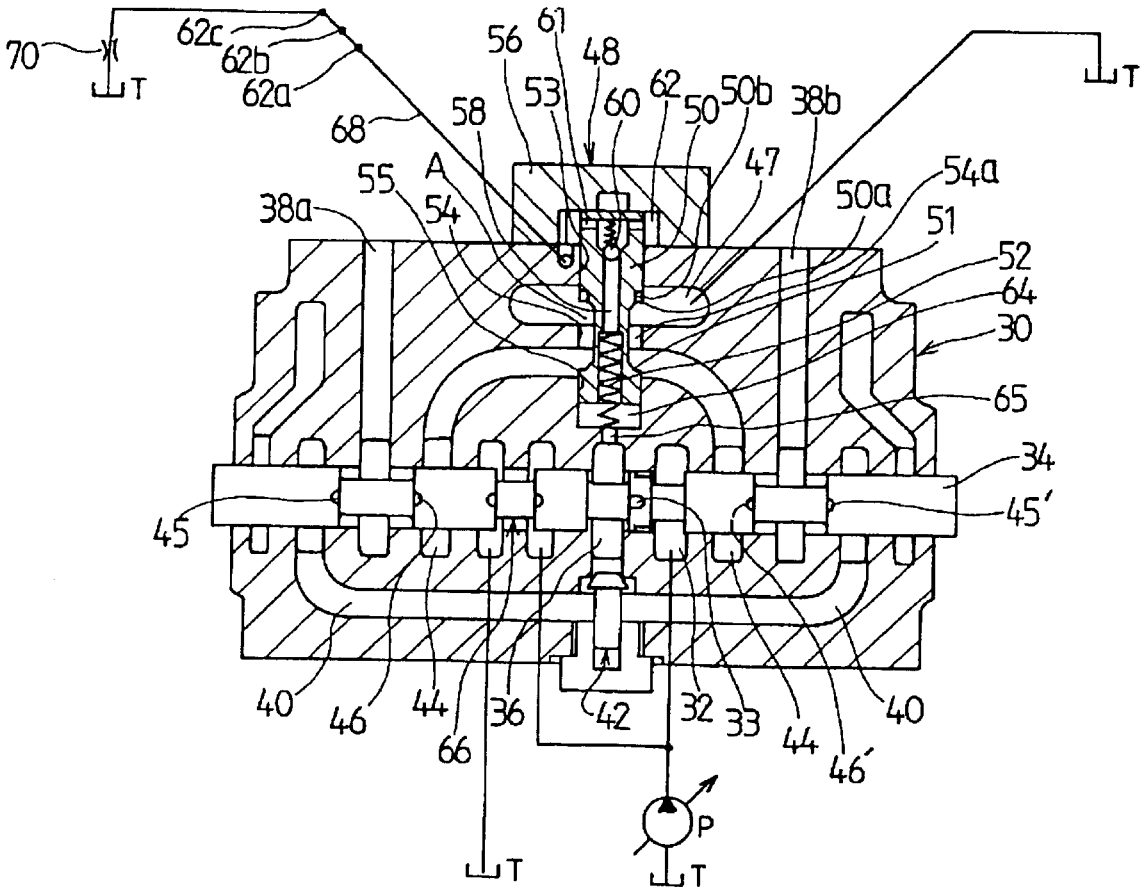
FIG. 1 is a cross sectional elevation view illustrative of a first novel hydraulic controller in a first embodiment in accordance with the present invention.

The present invention provides a hydraulic controller comprising: a plurality of switching spools; a plurality of cylinder ports of a switching valve; a compressed oil passage common to the switching valves having an intermediate chambers, at least a check valve in correspondence with at least a part of said switching spools, and said check valve being positioned between said intermediate chambers and said cylinder ports, so that said switching spools being positioned in a neutral position to close said passage and also being movable to adjust opening degree of said passage, wherein auxiliary ports are provided between the cylinder ports and a tank line; flow rate adjusters are also provided between the auxiliary ports and the tank line for adjusting an opening degree of the passage; pressure detectors are provided in the switching valves for detecting pressures of oils in the intermediate chambers; a maximum pressure selector operatively linked to said pressure detectors for selecting a maximum pressure from the detected pressures by the pressure detectors; whereby the pressures of said intermediate chambers are applied to the flow rate adjusters in an opening direction, whilst the selected maximum pressure selected by said maximum pressure selector is applied to the flow rate adjusters in a closing direction.

It is preferable that each of said flow rate adjusters comprises a spool having has a first side opened to said intermediate chamber and a second side opened to corresponding one of plural back chambers connected to each other through back chamber passages, so that oils in said intermediate chambers are introduced through said check valves to said back chambers.

The flow rate regulating device may be provided with a first spring applying a first spring force to the spool of the flow rate regulating device in such a first direction that a passage between an auxiliary port and the tank line is forced in an opening position.

The flow rate regulating device may be provided with a second spring applying a second spring force to the spool of the flow rate regulating device in such a second direction that a passage between an auxiliary port and the tank line is forced in a closing position.

It is possible that the first and second springs have different spring forces from each other.

The switching valve may be of an open-center type.

The switching valve may be of a closed-center type.

In the hydraulic controller, a compressed oil is generated by a variable capacity pump. A pressure generating device is provided at a lowermost downstream of a center-bypass for the plural switching valves, so as to adjust a discharge flow rate of the variable capacity pump in accordance with a pressure in an upstream side of the pressure generating device.

It is also possible that a discharge flow rate of the variable capacity pump may be adjusted in accordance with a pressure in an upstream side of the pressure generating device.

Preferred embodiments of the present invention will be described with reference to the accompanying drawings.

First embodiment

FIG. 1 is a cross sectional elevation view illustrative of a first novel hydraulic controller in a first embodiment in accordance with the present invention.

The first novel hydraulic controller has a valve body 30 which comprises the following elements. The valve body 30 has a compressed oil passage 32 for a compressed oil from a variable capacity pump P. The valve body 30 also has a switching spool 34. The valve body 30 also has an intermediate chamber 36 for receipting a supply of the compressed oil from the compressed oil passage 32 upon movement of the switching spool 34. The valve body 30 has cylinder ports 38*a* and 38*b*. The valve body 30 also has passages 40, 40 connecting from the intermediate chamber 36 to the cylinder ports 38*a* and 38*b* respectively. The valve body 30 also has a check valve 42. The valve body 30 also has an auxiliary port 44 for allowing the compressed oil to be discharged from the cylinder port 38*a* or 38*b* and supplied into a tank T upon movement of the switching spool 34. The valve body 30 also has a tank line 47.

Furthermore, the switching spool 34 is provided with a recessed portion 33 for connecting the compressed oil passage 32 to the intermediate chamber 36 so that the compressed oil is fed upon movement of the switching spool 34. The switching spool 34 is also provided with other recessed portions 45, 45', and 46, 46' for connecting the cylinder ports 38*a* and 38*b* to the passage 40 and auxiliary port 44 so that the compressed oil is fed upon movement of the switching spool 34.

The auxiliary ports 44 and 44 are interposed between the cylinder ports 38*a*, 381*b* and the tank line 47. The flow rate regulating device 48 is also interposed between the auxiliary ports 44 and 44 and the tank line 47 for adjusting an opening degree "A" of the passage from the cylinder ports 38*a*, 38*b* to the tank line 47.

The flow rate adjusting device 48 is further provided with a spool 50 and a spring 52. The spools 50 are provided in spool holes 53, 54, and 55 formed in the valve body 30 so that the spools 50 are slideable and tightly shield and further covered in one side with covers 56. The spool 50 has an internal passage 58 which has one end connected through the check valve 60 and the passage 61 to a back chamber formed in the cover 56, whilst the opposite end is opened to a front chamber 64, The check valve 60 prevents the flow of the compressed oil from the back chamber 62 to the front chamber 64.

The front chamber 64 is connected through a passage 65 to the intermediate chamber 36. The front chamber 64 is also provided therein with a spring 52 for applying a spring force to the opposite end of the spool 50.

Accordingly, the flow rate adjusting device 48 is so constructed that upon the moving of the spool 50 downwardly opposing to the spring force of spring 51, a shoulder portion 50*a* of the spool 50 becomes engaged with the spool hole 54, whereby the opening degree A is controlled by the recessed portion 50*b* so that as the shoulder portion 50*a* comes closer to the spool 50, the opening degree A is becomes small.

As a modification to the above, it is possible that the above open-center type hydraulic controller may be replaced by the closed-center type hydraulic controller.

In this embodiment, the hydraulic controller has a plurality of the switching valves, wherein the back chamber 62 of the switching valve is connected through the passages 68 to each of the back chambers 62*a*, 62*b*, and 62*c* in the flow rate adjusting device of the switching valves and the passage 68 is further connected through a throttle 70 to the tank T.

Operations of the above novel hydraulic controller will subsequently be described.

(1) Operation of one of the switching spools

When any one of the switching spool is operated, then the above novel hydraulic controller shows the following operations. As the switching spool 34 is moved in a right direction, the recessed portion 33 provided in the switching spool 34 becomes aligned to the compressed oil passage 32, whereby the compressed oil passage 32 becomes opened. As a result, the compressed oil is flowed through this opening into the intermediate chamber 36. This compressed oil opens the check valve 42 to further flow through the passage 40 and the recessed portion 45' provided in the switching spool 34 to the cylinder port 38*b*, whereby the compressed oil is finally supplied to an actuator which is not illustrated.

A returned oil from the actuator is flowed through the cylinder port 38*a*, the recessed portion 46 provided in the switching spool 34 to the auxiliary port 44. Subsequently, the oil is further flowed to the tank line 47 through a circle passage 54*a* which is defined by a cavity 51 of the spool 50 of the flow rate regulating device 48 and a spool hole 54 provided in the valve body 30. The oil is finally supplied to the tank T.

In this case, the compressed oil in the intermediate chamber 36 is flowed through the passage 65, the front chamber 64, the internal passage 58 of the spool 50, the check valve 60, and the passage 61 to the back chamber 62 finally. Furthermore, the compressed oil is flowed through the passage 68 to the back chambers 62*a*, 62*b*, and 62*c* of the other switching valves. This oil is flowed through the relatively small throttle to the tank T, for which reason the back and front chambers 62 and 54 are almost the same in pressure. Moreover, in this case, since the spool 50 keeps the opening degree A of the circle passage 54*a* in the opening position by the spring force of the spring 52 provided in the front chamber 64, the returned oil from the cylinder port 38*a* is supplied to the tank T without any restriction by the flow rate regulating device 48.

(2) Concurrent operation of a plurality of the switching spools in higher load side:

The spool 50 in the higher load side shows the same operation as when a single switching spool is operated as described above, for which reason the description will be omitted to avoid duplicate descriptions.

(3) Concurrent operation of a plurality of the switching spools in lower load side:)

When the switching spools 34 are moved in the right direction, the flow direction of the compressed oil is the same as when the single switching spool is operated as described above. Notwithstanding, in the flow rate regulating device 48, a pressure of the compressed oil in the intermediate chamber 36 in the higher load side is applied through the passage 68 to the back chamber 62. The compressed oil is prevented by the check valve 60 in the spool 50 in the lower load side from being flowed into the front chamber 64 in the lower load chamber 64, for which reason the back chamber 62 in the lower load side is higher than the front chamber 64 in the lower load side. Accordingly, if a pressure difference between the front and back chambers 64 and 62 exceeds the spring force of the spring 52, then the spool 50 is forced to be moved downwardly.

In flow rate regulating device 48, the circle passage 54*a* is narrowed by the shoulder portion 50*a*, for which reason the opening degree A is controlled. Accordingly, the returned oil from the cylinder port 38*a* on the flow to the tank line 47 receives a resistance and further a pressure rising is caused in a supplying side of the compressed oil to the actuator not illustrated, or the supplying side of the compressed oil to the cylinder port 38*b*.

As a result, the pressure of the compressed oil in the front chamber 64 of the flow rate regulating device 48 is risen, for which reason if the spring force of the spring 52 is set relatively small, then the spool 50 becomes equilibrated in an equilibrium point where the front chamber 64 and the back chamber 62 are balanced in pressure under the control of the opening degree A. Thus, the pressures of the compressed oils in the front chamber 64 and the intermediate chamber 36 connecting thereto becomes almost the same as the pressure in the intermediate chamber 36 but in the higher load side. Therefore, the compressed oil from the compressed oil passage 32 may be supplied to both the higher and lower load sides concurrently and in accordance with the opening degree "A" of the recessed portion 33 of the individual switching spool 34.

In contrast to the above novel hydraulic controller, the conventional hydraulic controller is engaged with the following problem. In the conventional hydraulic controller, the flow rate regulating device for controlling the opening degree in the lower loaded side in two switching valves concurrent operation is provided between a compressed oil supplying passage and a cylinder port. When a single switching valve is operated alone, it is needed to carry out a sufficiently high speed driving of the actuator connected to the switching valve, for which reason it is necessary to set sufficiently large the opening degree of the recessed portion of the switching spool in the side of discharging the returned oil from the cylinder port to the tank line. Notwithstanding, when the plural switching spools are concurrently operated, the switching spool in the lower load side has the following problems. As the opening in the discharge side is widen, the resistance is effected to the passage in the supplying side of the actuator. For this reason, when the empty weight is applied as the external force to the actuator, the actuator is cased to be dropped at a high speed due to a reduced resistance of the passage in the discharge side of the returned oil. However, the resistance in an entrance side of the passage is high, for which reason a cavitation is caused in the entrance side. This cavitation provides a great deal of danger on operations of the actuators. In order to solve those problems, it may be considered to make smaller the opening degree of the passage in the discharge side. Nevertheless, there is raised another problem with drop of the operation speed of the single switching spool operation.

In accordance with the present invention, however, the above novel hydraulic controller is free from the problems engaged with the conventional hydraulic controller. In order to obtain the sufficiently high speed on the single switching spool operation, the opening degree of the passage in the discharge side is controlled even when the switching valve in the lower load side is set large in opening degree, for which reason even when the empty weight of the actuator connected to the switching valve is effected as the external force, it is impossible that the controller enters into inoperable state. Further, a high safety operation can be realized, Accordingly, the sufficiently high operation speed and the high safety on the concurrent plural switching spool operations can be obtained.

In the novel hydraulic controller shown in FIG. 1, the spring 52 is provided in front chamber 64 against the spool 50 of the flow rate regulating device 48, so that the spool 50 is kept in opening position by the spring force of this spring 52.

As a modification, however, it is also possible that the spring 52 is provided in the back chamber 62 so that the spring force follows the empty weight thereby obtaining substantially the same effects.

Figure 2:
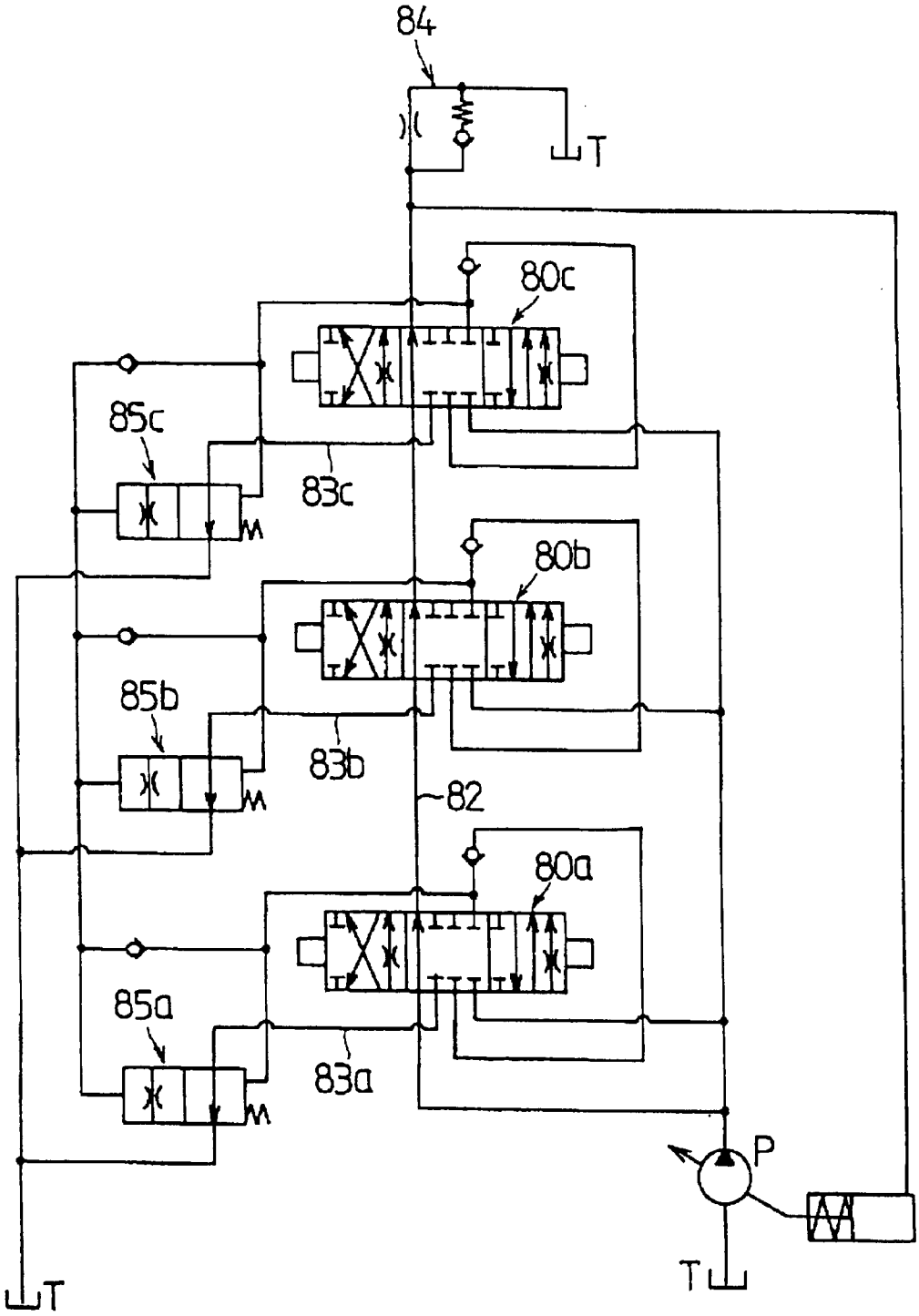
FIG. 2 is a schematic diagram illustrative of another novel hydraulic controller in the second embodiment in accordance with the present invention.

Second embodiment:

FIG. 2 is a schematic diagram illustrative of another novel hydraulic controller in the second embodiment in accordance with the present invention. The novel hydraulic controller in the second embodiment has the open-center type switching valve.

A pressure generating device 84 is provided in the discharge side or the downstream side of a center-bypass passage 82 of the switching valves 80*a*, 80*b*, and 80*c*. For the supplying passages to the actuators of the switching valves of 80*a*, 80*b*, and 80*c*, bypass circuits 83*a*, 83*b*, and 83*c* are respectively provided. Further, variable throttles 85*a*, 85*b*, and 8.5*c* are provided to the bypass circuits 83*a*, 83*b*, and 83*c*. In this case, the load pressures of the returned oil of the actuators connected to the corresponding switching valves 80*a*, 80*b*, and 80*c* are applied in opening directions of the variable throttles 85*a*, 85*b*, and 85*c*. The load pressures of the returned oil of the actuators connected to the corresponding switching valves 80*a*, 80*b*, and 80*c* are introduced in closing directions to the variable throttles 85*a*, 85*b*, and 85*c*.

In accordance with the novel hydraulic controller, the discharge flow rate from a variable capacity pump P is adjusted in corresponding to the pressure of the composed oil in the upstream side of the pressure generating device 84. Thus, if the regulating method for the discharge flow rate from the variable capacity pump P is of the negative flow rate controlling method, movements of the switching spools of the individual switching valves 80*a*, 80*b*, 80*c* results in reduction in the quantity of the passing oil through the center-bypass passage 82, so that the oil pressure in the upstream side of the pressure generating device 84 is dropped, whereby the discharged flow rate from the variable capacity pump P is increased whilst the discharged oil is supplied to the corresponding actuators through the switching valves 80*a*, 80*b*, and 80*c*. When the plural switching valves are concurrently operated, the compressed oil under the negative flow rate control from the variable capacity pump P is allocated to the individual actuators in accordance with the respective opening degrees of the switching valves 80*a*, 80*b*, and 80*c*.

In contrast to the above novel hydraulic controller, the conventional hydraulic controller having variable capacity pumps in the negative control flow rate system is engaged with the following problems. The flow rate distributions upon concurrent operations of the plural switching valves are made to the corresponding actuators receiving different loads, wherein the common supplying passage is divided into plural passages to the individual switching valves. Fixed throttles or variable throttles are provided on the divided passages for step-like adjustment to the opening degrees in accordance with external signals. Variations in rotational speed of the pump driver for driving the variable capacity pump and in loads to the actuators connected to the individual switching valves case variation in distributing rate of the compressed oils to be distributed to the respective switching valves. This means it difficult to accurately operate the hydraulic controller.

In accordance with the present invention, however, the distribution ratio of the compressed oil into the individual switching valves 80*a*, 80*b*, and 80*c* from the variable capacity pump P is always constant independently from the driving conditions and the load condition of the actuators, This may greatly improves the operability in the concurrent operations of the plural switching spools.

Figure 3:
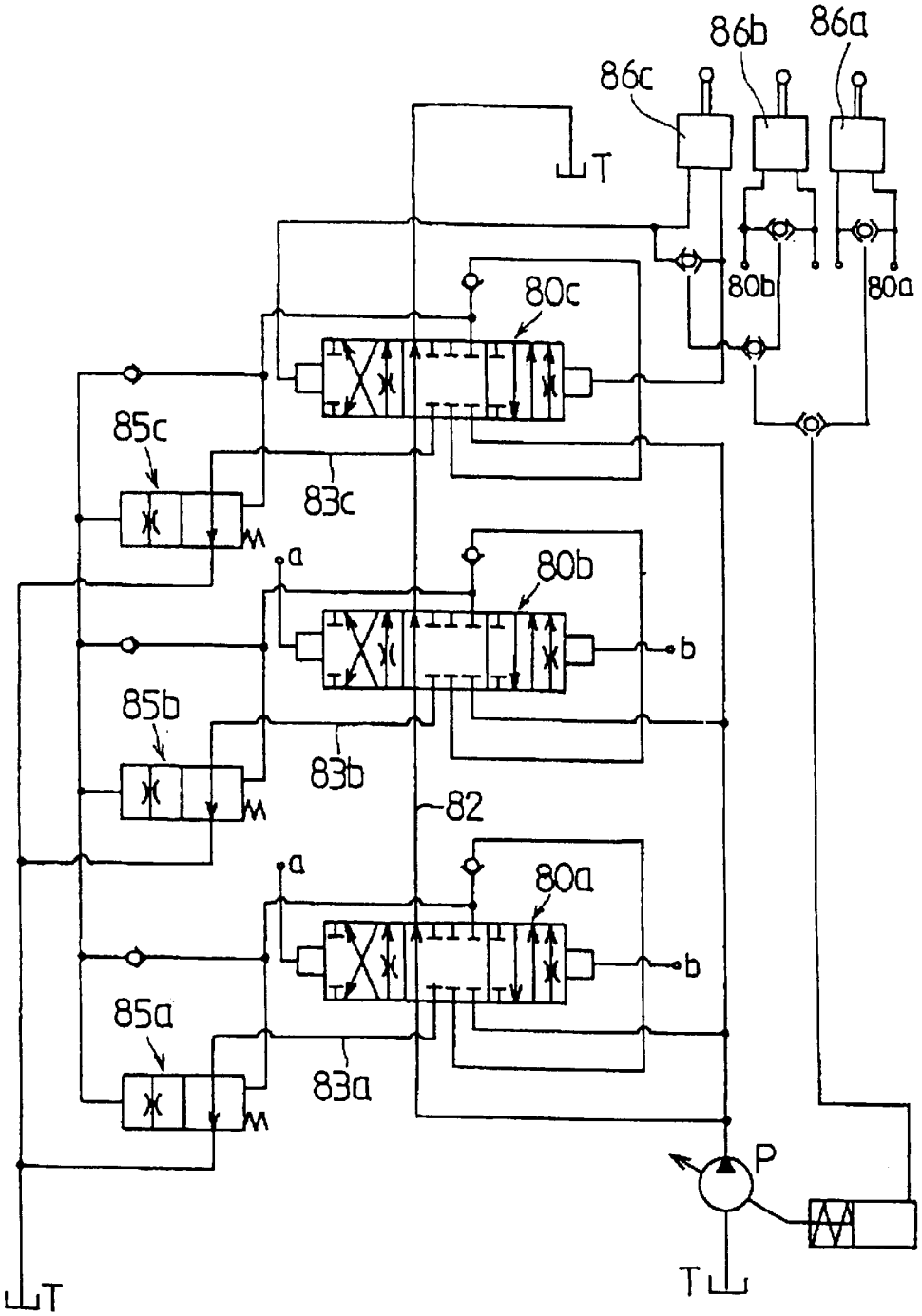
FIG. 3 is a schematic diagram illustrative of still another novel hydraulic controller in the third embodiment in accordance with the present invention.
Figure 4:
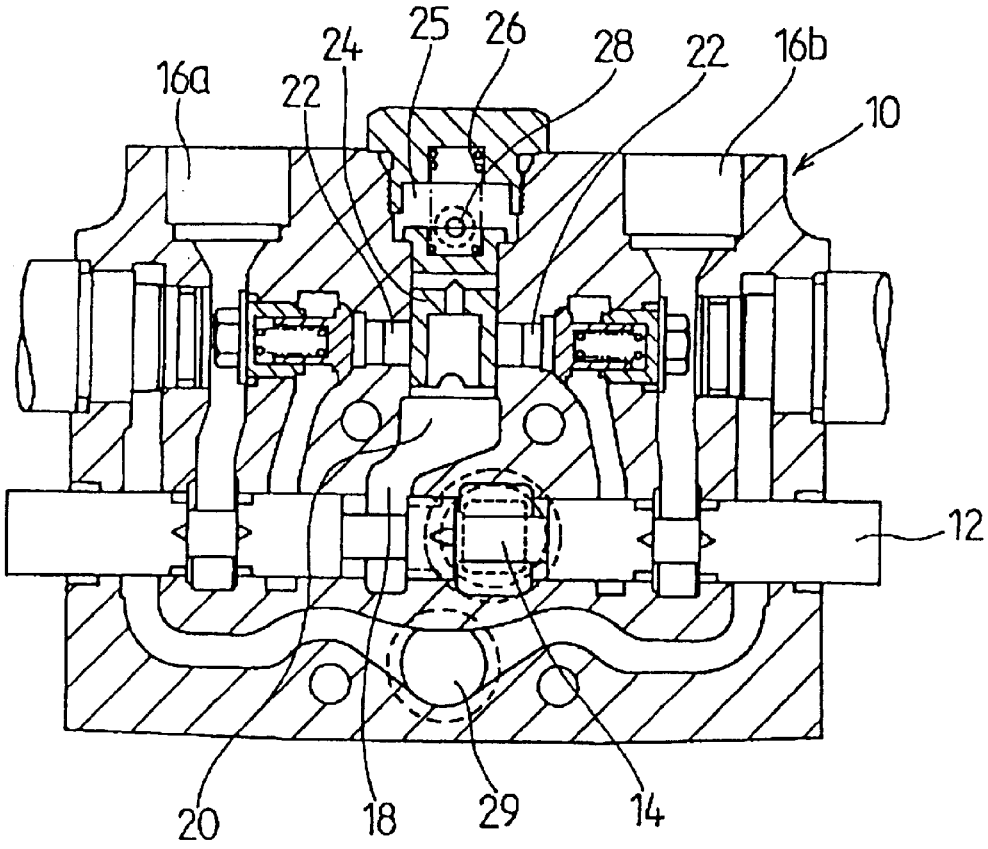
FIG. 4 prior art
FIG. 4 is a cross sectional elevation view illustrative of the conventional hydraulic controller.

Third embodiment:

FIG. 3 is a schematic diagram illustrative of still another novel hydraulic controller in the third embodiment in accordance with the present invention. This novel hydraulic controller has a variable capacity pump of a positive flow rate controlling system, wherein a discharge flow rate is increased in according to the increase in the movements of the switching spools of the switching valves, in place of the hydraulic controller having the variable capacity pump of the negative flow rate controlling system in the Embodiment 2 illustrated in FIG. 2.

Instead of the pressure generating device 84 in FIG. 2 of Example 2, the hydraulic controller illustrated in FIG. 3 in this embodiment is provided with each of pilot valves 86*a*, 86*b*, and 86*c* for operations of the switching valves thereby to operate the corresponding switching valves 80*a*, 80*b*, and 80*c*. The discharge flow rate from the variable capacity pump P is controlled by the positive flow rate controlling system under a selected maximum load pressure which is selected from load pressures of the returned oils of the actuators connected to the switching valves. Other structure of this third novel hydraulic controller in FIG. 3 is the same as the second novel hydraulic controller in FIG. 2, for which reason the duplicate descriptions will be omitted.

Thus, the same effect as the negative flow rate controlling system in Example 2 illustrated in FIG. 2 can be obtained.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A hydraulic controller comprising:

a plurality of switching spools;

a plurality of cylinder ports of switching valves;

a compressed oil passage common to the switching valves having intermediate chambers;

at least a check valve in correspondence with at least a part of said switching spools, said check valve being positioned between said intermediate chambers and said cylinder ports, so that said switching spools are positioned in a neutral position to close said passage and also being movable to adjust an opening degree of said passage;

auxiliary ports being provided between the cylinder ports and a tank line;

flow rate adjusters being provided between the auxiliary ports and the tank line for adjusting said opening degree of the passage;

pressure detectors being provided in the switching valves for detecting pressures of oils in the intermediate chambers; and a maximum pressure selector operatively linked to said pressure detectors for selecting a maximum pressure from the detected pressures by the pressure detectors, whereby the pressures of said intermediate chambers are applied to the flow rate adjusters in an opening direction, and the selected maximum pressure selected by said maximum pressure selector is applied to the flow rate adjusters in a closing direction.

2. The hydraulic controller as claimed in claim 1, wherein each of said flow rate adjusters comprises a spool having a first side opened to said intermediate chamber and a second side opened to a corresponding one of plural back chambers connected to each other through back chamber passages, so that oils in said intermediate chambers are introduced through said check valves to said back chambers.

3. The hydraulic controller as claimed in claim 2, wherein each of said flow rate adjusters further comprises a spring for applying a spring force to the spool in such a direction that a passage between an auxiliary port and the tank line is forced in an opening position or a closing position.

4. The hydraulic controller as claimed in claim 3, wherein the springs of the flow rate adjusters have different spring forces from each other.

5. The hydraulic controller as claimed in claim 1, wherein each of the switching valves comprises an open-center type switching valve.

6. The hydraulic controller as claimed in claim 5, wherein each of the switching valves has a center-bypass for flowing an oil from a variable capacity pump to the tank.

7. The hydraulic controller as claimed in claim 6, wherein a discharge flow rate of the variable capacity pump is adjusted in accordance with a pressure in an upstream side of a pressure generating device provided at a lower-most position downstream of the center-bypasses of the switching valves.

8. The hydraulic controller as claimed in claim 6, wherein a discharge flow rate of the variable capacity pump increases according to an increase in movements of the switching valves.

9. The hydraulic controller as claimed in claim 6, further comprising:

pilot valves for operating the switching valves, and wherein a discharge flow of the variable capacity pump is adjusted in accordance with a selected maximum load pressure selected from load pressures of returned oils.

10. The hydraulic controller as claimed in claim 1, wherein each of the switching valves comprises a closed-center type switching valve.

* * * * *